US007178173B2

(12) United States Patent
Kronenberger

(10) Patent No.: US 7,178,173 B2
(45) Date of Patent: Feb. 20, 2007

(54) APPARATUS FOR SHAPING AND/OR PLACING INFORMATION ON A BASEBALL-STYLE CAP

(75) Inventor: Robert Kronenberger, Deerfield, IL (US)

(73) Assignee: American Needle, Buffalo Grove, IL (US)

( * ) Notice: Subject to any disclaimer, the term of this patent is extended or adjusted under 35 U.S.C. 154(b) by 0 days.

(21) Appl. No.: 11/070,107

(22) Filed: Mar. 1, 2005

(65) Prior Publication Data

US 2006/0195970 A1 Sep. 7, 2006

(51) Int. Cl.
*A42B 1/24* (2006.01)

(52) U.S. Cl. ..... 2/209.13; 2/175.2

(58) Field of Classification Search ..... 2/209.13, 2/175.2; 40/329; 223/14, 84; D2/866, 873, D2/886, 893

See application file for complete search history.

(56) References Cited

U.S. PATENT DOCUMENTS 3,858,769 A * 1/1975 Billingslea, Jr. ..... 223/84
5,003,639 A * 4/1991 White ..... 2/46
5,634,575 A * 6/1997 Scharrenberg ..... 223/84
5,647,064 A 7/1997 Whittaker
5,908,146 A 6/1999 Levin
5,991,927 A * 11/1999 Barbaccia ..... 2/209.13
D419,281 S * 1/2000 Croft ..... D2/891
6,510,972 B1 * 1/2003 Briskey ..... 223/24
6,655,558 B2 12/2003 Lawrance
6,694,526 B1 * 2/2004 Tate ..... 2/209.12
6,755,329 B2 6/2004 Thompson
6,824,027 B2 * 11/2004 Frey ..... 223/14
2002/0042941 A1 * 4/2002 Grundy ..... 2/195.1

* cited by examiner

*Primary Examiner*—Katherine Moran
(74) *Attorney, Agent, or Firm*—Wood, Phillips, Katz, Clark & Mortimer

(57) ABSTRACT

The combination of a headwear piece and an attachment. The headwear piece has a crown with a circumference and a bill projecting away from the crown and extending less than fully around the circumference of the crown. The bill has a peripheral edge including a front edge portion which blends into spaced first and second side edge portions. The attachment is provided at least partially on the bill. The attachment engages the bill at the front edge portion and exerts a biasing force on the bill tending to impart a curve shape to the bill.

21 Claims, 5 Drawing Sheets

APPARATUS FOR SHAPING AND/OR PLACING INFORMATION ON A BASEBALL-STYLE CAP

FIELD OF THE INVENTION

This invention relates to baseball-style caps and, more particularly, to an apparatus that can be placed on a bill of the cap to control the shape thereof and/or provide a space for the placement of information, such as advertising material.

BACKGROUND ART

Baseball caps are becoming increasingly popular worldwide. What once originated as a functional item for athletes has now evolved into aa regular n apparel item for persons in all walks of life. Baseball caps are currently offered in categories ranging from those that are purely ornamental, or that bear information that is purely for entertainment purposes, to those bearing information relating to team identification or information relating to businesses, events, etc.

The proliferation of baseball caps with athletic team identification thereon has led to the development of many different types of displays, manners of displaying those caps. At one point in time, baseball caps with an identification of a team thereon, were generally made available only in geographic regions close to where that team played. A limited number of designs made possible a relatively compact display with few choices for the consumer.

Merchandising of team paraphernalia has changed drastically since that time. The headwear industry has now targeted not only fans loyal to local teams but collectors and those seeking a wide range of different style and different designs for a particular team. Thus, a point-of-purchase display for baseball caps may contain hundreds of different designs, which are placed for convenient surveillance by a potential purchaser. The goal of the designers of such displays is to present the caps in an aesthetically pleasing manner without requiring excessive amounts of space.

Another objective of the designers of basic displays is to present the caps so that they are in the most commonly accepted shape. At the time of manufacture, most baseball caps are made with the collapsible crown and a bill which projects forwardly from the crown and normally through less than half the circumference of the crown. The bill is secured to the crown so that the bill generally has a gently curved, inverted, "U" shape as viewed in front elevation. From this shape, wearers may deviate, as by providing creases to define a more squared "U", or by other commonly used reconfigurational techniques. However, the original, smoothly curved inverted U shape is that which is maintained by both wearers. Most displays are thus designed to feature caps in this configuration.

It is common for potential consumers to try headwear on at the point-of-purchase displays. In doing so, they may re-shape the bill from its original configuration to a more personally preferred configuration. The result of this may be that the caps at a particular display may have different bill configurations resulting from the actions of potential purchasers.

The industry has devised a number of different apparatus for re-shaping the bills to their original curvature. Examples thereof are shown in each of U.S. Pat. No. 5,634,475 (Scharrenberg); U.S. Pat. No. 5,991,927 (Barboccia); U.S. Pat. No. 6,510,972 (Briskey); U.S. Pat. No. 6,655,558 (Lawrence); and U.S. Pat. No. 6,755,329 (Thompson). Certain of these, such as those shown in Briskey and Levin, are relatively bulky and not practical for use at point of purchase. While Thompson shows a relatively unobtrusive device for re-shaping a bill, the apparatus is installed midway between the front of the bill and the crown, at which a relatively substantial force must be imparted to effect any appreciable formation of the bill. Thus, the device may have to be quite stiff, thereby generally adding to its cost. Additionally, the bill may become damaged as installation or removal of the apparatus is effected. Consequently, generally little has been done to date at point of purchase to maintain or re-establish the original curvature of the bills on baseball caps.

Another problem that has persisted with existing displays is that of readily making known to the prospective purchasers the identity of the manufacturer or distributor of the headwear. Heretofore, the most common methods of identification have been the use of sewn in tags on the inside of the crown and hang tags which are releasably secured for display on the inside or outside of the crown. These conventional identification techniques generally require that the prospective purchaser individually pick up and inspect the headwear pieces to make such an identification.

Brand recognition has been particularly a problem with respect to baseball caps that are "stacked" in a horizontal array. With this type of display, the crowns are normally collapsed from rear to front to define a rearwardly opening, curved receptacle. This receptacle accommodates the front of the crown of a cap displayed immediately therebehind. In other words, the caps are nested, one within the other, in a line with the bill of the forwardmost cap exposed and the bills on the remainder of the caps underlying the bill of the cap immediately forward thereof. This compact arrangement allows the prospective purchaser to leaf through the nested crowns to make an appropriate selection. Until a particular cap is separated and inspected, there is generally no easy way to identify the manufacturer. This presents a problem to those manufacturers/distributors that wish to be identified amongst the products of potentially a large number of other manufacturers/distributors displaying their wares at the same location.

The industry continues to contend with the above problems due to the absence of any viable solution. This problem is contended with not only with baseball caps, but other billed headwear, such as visors, and the like, which in conjunction with baseball caps, will be considered "baseball" caps, for all purposes herein.

SUMMARY OF THE INVENTION

In one form, the invention is directed to the combination of a headwear piece and an attachment. The headwear piece has a crown with a circumference and a bill projecting away from the crown and extending less than fully around the circumference of the crown. The bill has a peripheral edge including a front edge portion which blends into spaced first and second side edge portions. The attachment is provided at least partially on the bill. The attachment engages the bill at the front edge portion and exerts a biasing force on the bill tending to impart a curve shape to the bill.

In one form, the bill is symmetrical about a center line, with the center line residing between first and second side portions of the bill. The attachment engages the bill at first and second locations, one each on the first and second side portions of the bill.

In one form, the first and second locations are at the front edge portion of the bill.

In one form, the bill has a top surface and a bottom surface and the attachment wraps around the peripheral edge of the bill and against the top and bottom of the bill surfaces.

In one form, the attachment is pressed fit to and frictionally maintained on the bill.

In one form, the attachment extends substantially fully across the front edge portion of the bill and over at least a part of each of the first and second side edge portions.

In one form, the attachment has a pre-formed curved shape corresponding to a desired curved shape for the bill.

In one form, the attachment has a front to rear dimension and the front to rear dimension of the attachment against the bottom surface of the bill is greater than the front to rear dimension of the attachment against the top surface of the bill.

The attachment may be made as a single piece.

In one form, the attachment is permanently joined to the bill. Alternatively, the attachment may be releasably joined to the bill.

In one form, the attachment has a portion that resides against the top surface of the bill and there is information applied to the portion of the attachment that resides against the top surface of the bill.

In one form, the attachment wraps around the edge of the bill over the entire front edge portion.

The headwear piece may be in the form of a baseball-style cap.

In one form, the crown has an opening therein through which a wearer's head is exposed with the headwear piece in an operative position on the wearer's head.

In another form, the headwear piece is a baseball cap.

With the attachment made as a single piece, it may be made from a molded plastic.

In one form, the crown has a front and rear, the bill projects forwardly from the crown, and the attachment defines a receptacle. The attachment is placed in an operative position on the bill by directing the attachment from front to rear relative to the bill so that the bill moves into the receptacle.

In one form, the receptacle is bounded by a wall surface and the bill abuts to the wall surface to consistently maintain the attachment in the operative position on the bill.

The wall surface may abut the front edge portion of the bill with the attachment in the operative position on the bill.

The invention is further directed to a method of displaying a headwear piece, which method may include the steps of: providing a headwear piece having a crown with a circumference and a bill projecting away from the crown and extending less than fully around the circumference of the crown, with the bill have a peripheral edge including a front edge portion which blends into spaced first and second side edge portions; providing an attachment; and placing the attachment in an operative position on the bill so that a) at least a portion of the attachment engages the bill at the front edge portion and b) the attachment exerts a biasing force on the bill tending to impart a curved shape to the bill.

The step of placing the attachment in an operative position may involve press fitting the attachment into the operative position so that the attachment is frictionally maintained in the operative position.

The step of press fitting the attachment into the operative position may involve translating the attachment relative to the bill along an assembly line.

The step of providing an attachment may involve providing an attachment with a U-shaped receptacle in which the front edge portion of the bill resides with the attachment in the operative position.

The step of providing an attachment may involve providing an attachment with a U-shaped receptacle bounded by a wall surface within which the front edge portion of the bill resides so that the front edge portion of the bill abuts to the wall surface with the attachment in the operative position.

The step of placing the attachment in an operative position may involve permanently placing the attachment in the operative position or releasably placing the attachment in the operative position.

In one form, the step of providing an attachment involves providing an attachment with information thereon that remains visible with the attachment in the operative position.

The method may further include the steps of selling the headwear piece to a customer and separating the attachment from the headwear piece before relinquishing control of only the headwear piece without the attachment to the customer, after sale thereof.

The method may further include the steps of removing the attachment from the headwear piece and placing the attachment in an operative position on another headwear piece.

DETAILED DESCRIPTION OF THE DRAWINGS

Figure 1:
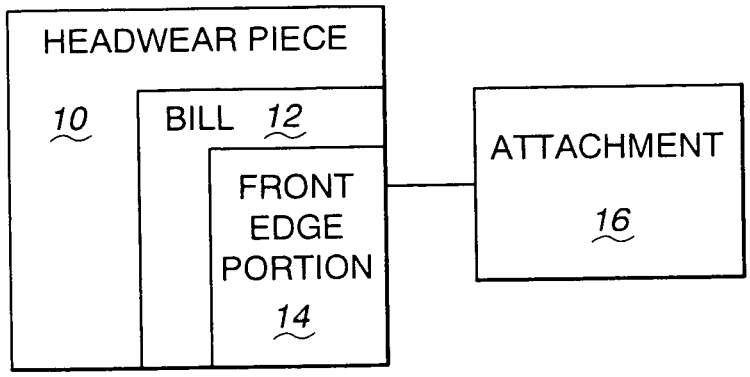
FIG. 1 is a schematic representation of a headwear piece with a bill having a frontage portion at which an attachment, according to the present invention, is placed in an operative position.
Figure 2:
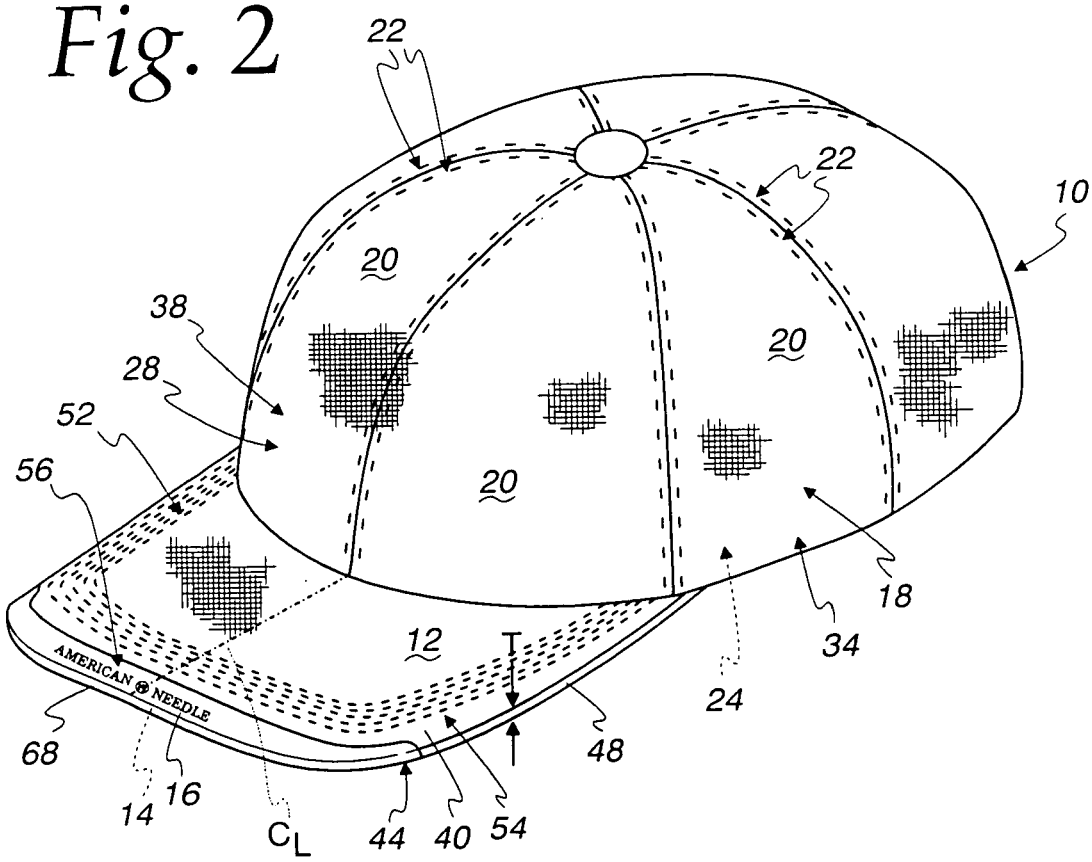
FIG. 2 is a perspective view of one form of headwear piece, as in FIG. 1, in the form of a baseball cap.

Referring initially to FIG. 1, the invention is shown schematically with respect to a headwear piece 10 having a projecting bill 12 with a peripheral edge having a front edge portion 14 at which an attachment 16, according to the present invention, is provided. The headwear piece 10 can take any of myriad different constructions known in the industry. For purposes of the description and claims herein, a suitable headwear piece 10 contemplated by the invention is what is typically referred to in the industry as a baseball-style cap, to include baseball caps and caps in the form of visors etc., having a crown with a circumference and a bill projecting angularly from the crown over less than the full circumference thereof. One specific form of the attachment 16 in headwear piece 10 will now be described, with it being understood that this form, and other disclosed herein, are exemplary in nature only. The nature of the headwear piece 10 and the attachment 16 may vary considerably from the specific examples thereof that will be shown and described herein.

Referring initially to FIGS. 2–6, one form of the headwear piece 10 is shown in the form of a baseball cap. The baseball cap 10 consists of a crown 18 defined by a plurality of triangularly-shaped gores 20 sewn edge-to-edge along lines of stitching 22 to produce an inverted, cup-shaped configuration. This configuration defines a receptacle 24 to receive a wearer's head, with the headwear piece 10 in an operative position on the wearer's head. The crown 18 defines an entry opening 26 through which the wearer's head is directed into the receptacle 24. The crown 18 has a front 28, a rear 30, and spaced sides 32, 34.

The bill 12 projects angularly away from a forwardly facing wall surface 38 on the crown 18. The bill 12 has a top surface 40 and bottom surface 42. The bill 12 has a peripheral edge 44 having a thickness T and made up of the front edge portion 14 which blends into spaced first and second sides edge portions 48, 50. The bill 12 is bisected by an imaginary center line CL extending in a fore-and-aft direction and dividing the bill 12 symmetrically into side portions 52, 54, that are mirror of each other around the center line CL.

Figure 4:
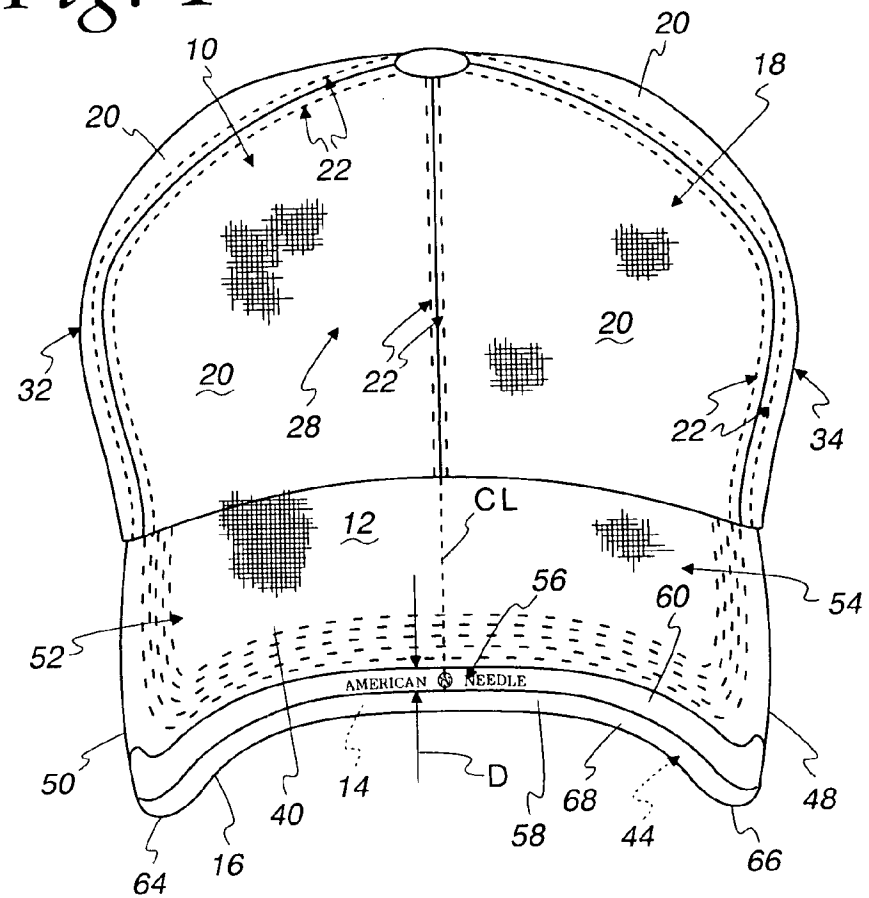
FIG. 4 is a front elevation view of the baseball cap in FIGS. 2 and 3.
Figure 3:
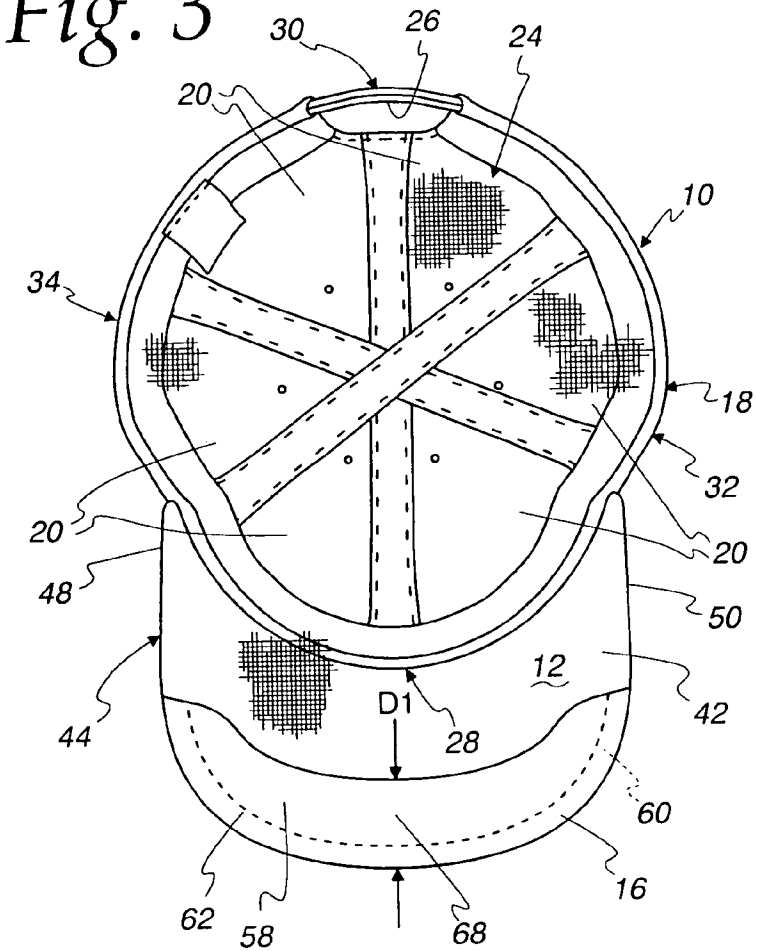
FIG. 3 is a bottom view of the baseball cap in FIG. 2.
Figure 5:
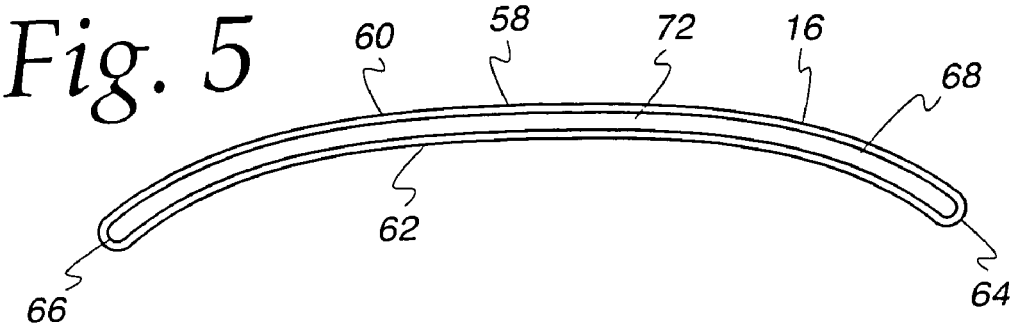
FIG. 5 is a rear elevation view of the attachment on the headwear piece in FIGS. 2–4.
Figure 6:
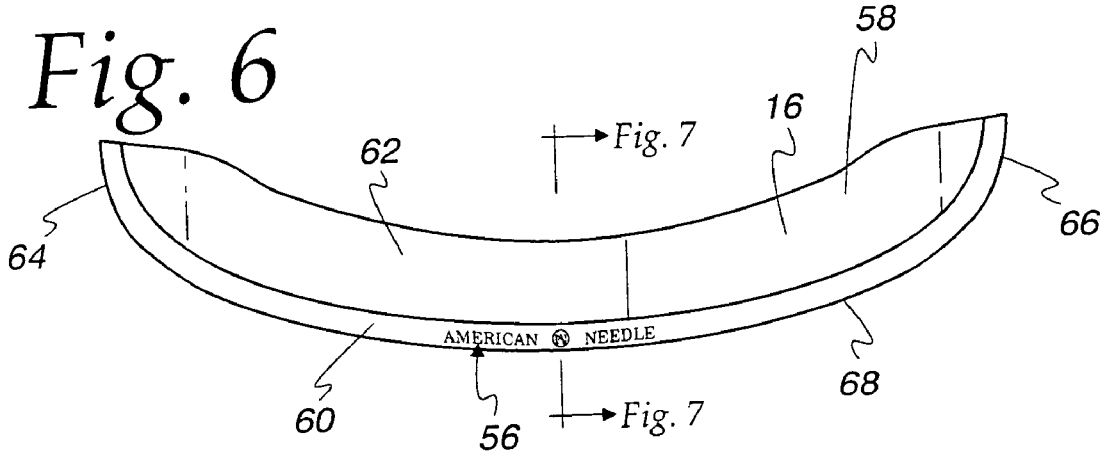
FIG. 6 is a plan view of the attachment in FIG. 5.
Figure 7:
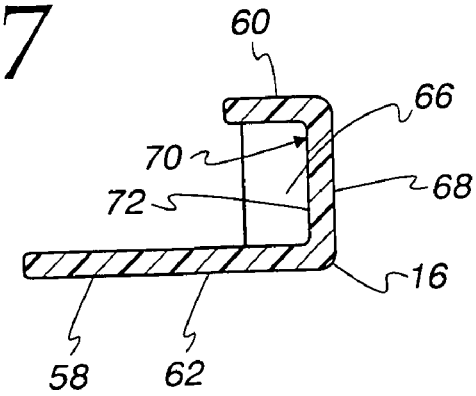
FIG. 7 is a cross-sectional view of the attachment taken along line 7—7 of FIG. 6.

The attachment 16 is placed in the operative position, shown in FIGS. 3 and 4, and serves at least one purpose, and more preferably two purposes. First of all, the attachment 16 provides a location upon which information, shown at 56, can be placed. The information 56 shown is in the nature of identification, in this case the assignee herein. The information may take any form, and may be in the nature of a logo, an identifying design, a description, etc.

Additionally, and more significantly, the attachment 16, in the operative position on the bill 12, exerts a biasing force on the bill 12 tending to impart the curved shape to the bill, as seen most clearly in FIG. 4; that being a gradually curved, inverted, "U" shape. As noted in the Background portion herein, this is typically the most generic configuration for baseball caps, which is "set" at the time of manufacture.

The attachment 16 may be made from any material, such as plastic, metal, a composite, etc. In one preferred form, the attachment 16 is made from a plastic material that can be readily molded to the shape shown. The attachment 16 has a body 58 consisting of a top wall 60 and a bottom wall 62 which merge at the sides thereof and at curved bight portions 64, 66. A front wall 68 connects between the top wall 60 and bottom wall 62, in this case fully between the bight portions 64, 66. The top wall 60, bottom wall 62, and front wall 68 cooperatively define a rearwardly opening, U-shaped receptacle 70 within which the front edge portion 14 nests with the attachment 16 in the operative position as shown in FIGS. 3 and 4. In the operative position, the front edge portion 14 abuts to a rearwardly facing surface 72 on a front wall 68 of the attachment 16.

In this embodiment, with the attachment 16 in the operative position on the bill 12, portions of the attachment 16 on opposite sides of the center line impart bending forces to the ball that produce the symmetrical bent shape shown in FIG. 4. At the same time, the for-and-aft dimension D for the top wall 60 can be made fairly small, preferably so as not to appreciably cover the top surface 40 of the bill 12, so that the top surface 40 remains exposed for inspection by a prospective purchaser. Accordingly, the information 56 can be applied in a manner to be prominent at the front of the headwear piece 10. At the same time, the headwear piece 10, and headwear pieces of like construction, can be stacked in such a manner that the information 56 can remain visible with this stacked arrangement, or exposed by a slight shifting of an overlying, displayed, headwear piece.

The particular shape of the top and bottom walls 60, 62 is a design consideration. The relatively small fore-and-aft dimension D on the top wall provides the advantages noted above. The corresponding fore- and-aft dimension D1 of the bottom wall 62 stabilizes the relationship between the attachment 16 and bill 12.

Aside from providing a location for the placement of information 56, and imparting a shaping force to the bill 12, the attachment 16 also gives an overall unique appearance that might be used to identify the manufacturer/distributor of the headwear piece 10. The wrapping of the attachment around the front edge portion 14, over/under to each of the top and bottom surfaces 40, 42, provides a unique visual effect.

The attachment 16 may be maintained in the operative position by reason of frictional forces between the attachment 16 and the bill 12. This makes the attachment 16 conveniently releasable from the headwear piece 10, thereby allowing the same to be re-used. With this arrangement, the attachment 16 could be provided by the store owner at a point-of-purchase display. After a sale is made, the attachment 16 can be separated from the headwear piece 10, so that the seller relinquishes control of only the headwear piece 10, and re-used on another headwear piece 10. Joining and separation of the bill 12 and attachment 16 can be effected by relative translational movement therebetween along an assembly line.

The attachment 16 could also be modified by changing its fore-and-aft extent. That is, the attachment 16 could be extended rearwardly to and provided at more of the peripheral edge 44 at either the top or bottom of the bill. Preferably, as noted above, the bill 12 remains exposed for inspection with the attachment 16 in the operative position.

Figure 8:
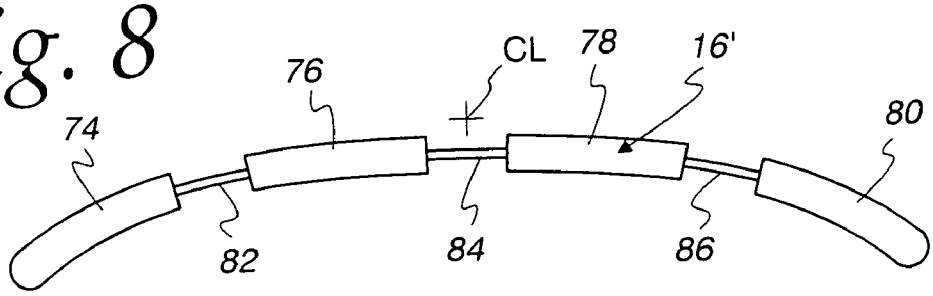
FIG. 8 is a front elevation view of a modified form of attachment, according to the present invention.

While the front wall 68, top wall 60, and bottom wall 62 of the attachment 16 have been shown to extend continuously across the full extent of the front edge portion 14 of the bill 12, this is not a requirement. As shown in FIG. 8, a modified form of attachment at 16' is made with individual segments 74, 76, 78, 80 joined by elements 82, 84, 86. All that is required according to the invention is that there be surfaces on opposite sides of the center line CL, that are placed at first and second locations, on opposite sides of the center line CL, and exert a force tending to bend the bill 12. One more simplified version of this concept is shown in FIGS. 9 and 10.

Figure 9:
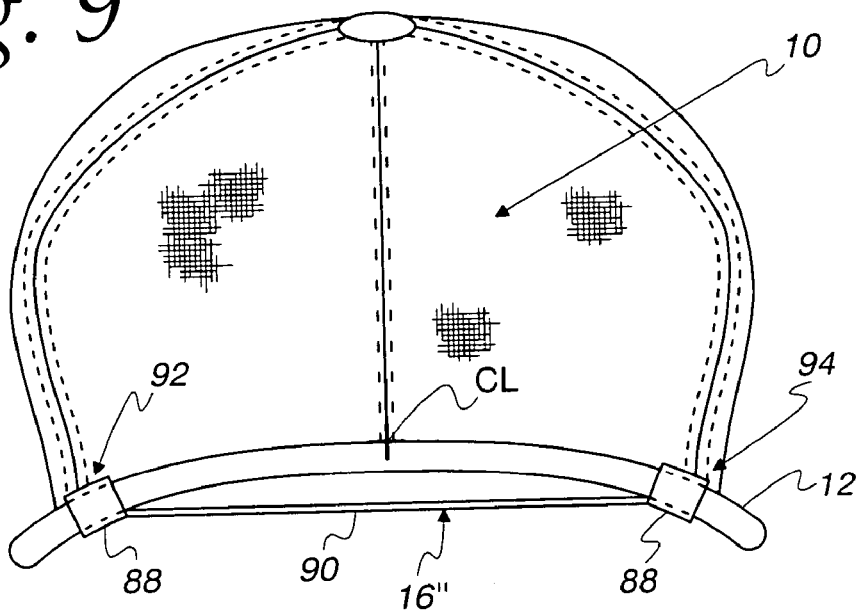
FIG. 9 is a front elevation view of a baseball cap of a further modified form of attachment, according to the present invention, in an operative position thereon.
Figure 10:
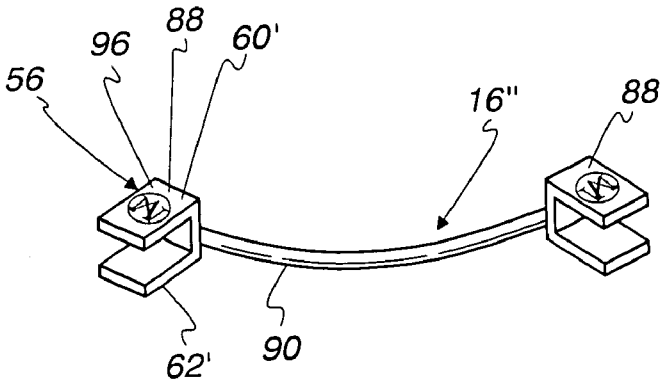
FIG. 10 is a perspective view of the attachment of FIG. 9 separated from the baseball cap.

In FIGS. 9 and 10, an attachment 16" is shown with like clips 88 interconnected by a flexible element 90. Alternatively and element (not shown) with a fixed rigid shape could be used. By engaging the clips 88 at spaced first and second locations 92, 94 on opposite sides of the center line CL, the connecting element 90 will generate a force on the clips that bends the bill 12 into the "U" shape, as previously discussed and shown in FIG. 9. The locations 92, 94 are selected based on the length of the element 90 to produce the desired bending force.

As shown in FIG. 10, the clips have top and bottom walls 60', 62', corresponding to the top walls 60, 62. The top wall 66' provides a surface 96 that is suitable for placement of information, as shown generally at 56.

Figure 11:
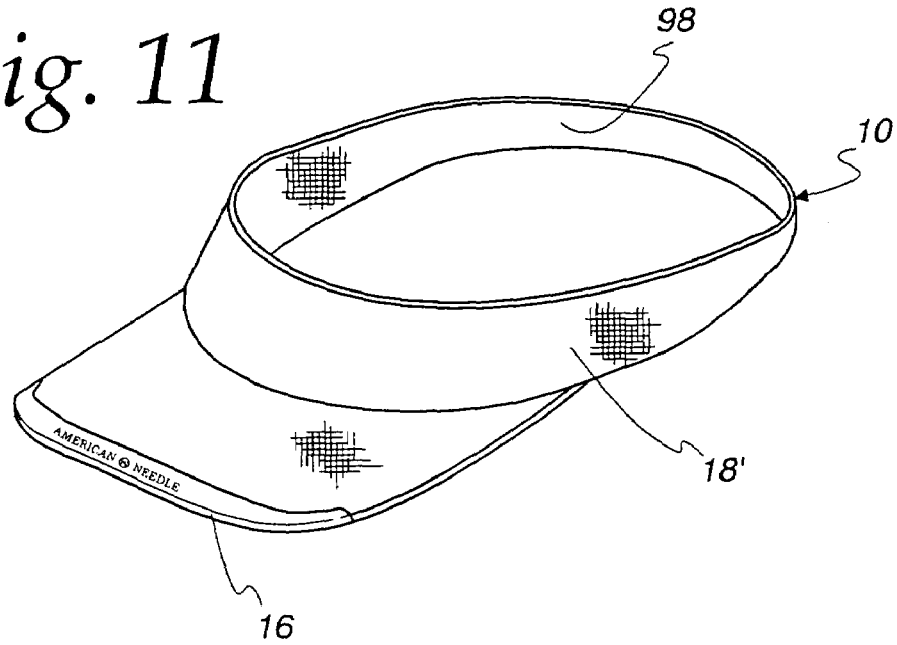
FIG. 11 is a perspective view of a further modified form of headwear piece, in the form of a visor, with the attachment in FIGS. 5–7 shown in an operative position thereon.

The attachment 16 is shown in FIG. 11 in an operative position on a headwear piece 10' that is a baseball-style cap in the form of a visor. The headwear piece 10' has a crown 18' with an opening 98 through which a wearer's head projects with the headwear piece in an operative position thereon.

Figure 12:
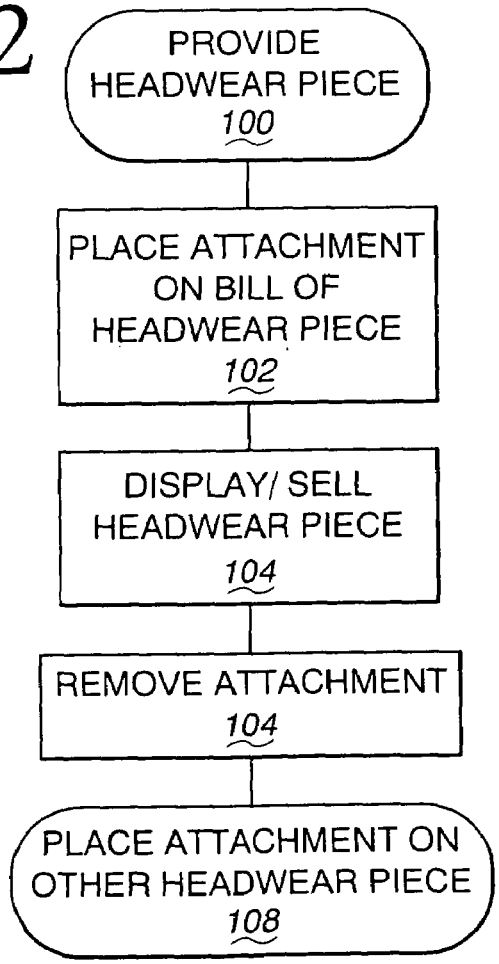
FIG. 12 is a flow diagram representation of a method of displaying a headwear piece, according to the present invention.

As shown in FIG. 12, with the inventive structure, the following display/merchandising method may be practiced, shown in flow diagram form in FIG. 12. As shown at block 100, a headwear piece 100 provided. As shown at block 102, the attachment 16, 16', 16" is placed in an operative position on the headwear piece 10, 10'. As shown at block 104, the headwear piece 10, 10' can be displayed/sold with the attachment 16, 16', 16"" thereon since the attachment 16. 16'. 16" is constructed so as not to cover the headwear piece as to preclude viewing thereof. As shown at block 106, the attachment can be removed either before or after sale. In the event that the attachment is permanently joined to the bill on the headwear piece, this step is not possible. The removed attachment 16, 16', 16" can be placed on another headwear piece for subsequent display, as for sale.

The foregoing disclosure of specific embodiments is intended to be illustrative of the broad concepts comprehended by the invention.

The invention claimed is:

1. In combination:

a) a headwear piece comprising a crown with a circumference and a bill projecting away from the crown and extending less than fully around the circumference of the crown, the bill having a front and rear, a top surface with an area, and a bottom surface, the bill further having a peripheral edge including a front edge portion that blends into spaced first and second side edge portions; and b) an attachment on the bill, the attachment engaging the bill at the front edge portion so as to consistently maintain the attachment in an operative position on the bill in a predetermined position in a direction between the front and rear of the bill and exerting a biasing force on the bill tending to impart a curved shape to the bill, the attachment constructed so that the attachment in the operative position does not: i) cover the headwear piece in a manner that would preclude viewing thereof for display; or ii) cover the entirety of the peripheral edge of the bill;

wherein the bill is symmetrical about a center line, with the center line residing between first and second side portions of the bill, and the attachment engages the bill at first and second locations, one each on the first and second side portions of the bill.

2. The combination according to claim 1 wherein the first and second locations are adjacent to the front edge portion of the bill.

3. The combination according to claim 2 wherein the attachment wraps around the peripheral edge of the bill and against the top and bottom bill surfaces.

4. The combination according to claim 1 wherein the attachment wraps around the peripheral edge of the bill and against the top and bottom bill surfaces.

5. The combination according to claim 1 wherein the attachment is press fit to and frictionally maintained on the bill.

6. The combination according to claim 1 wherein the attachment extends substantially fully across the front edge portion of the bill and over at least a part of each of the first and second side edge portions.

7. The combination according to claim 1 wherein the attachment has a pre-formed curved shape corresponding to a desired curved shape for the bill.

8. The combination according to claim 1 wherein the attachment comprises a single piece.

9. The combination according to claim 8 wherein the single piece comprises molded plastic.

10. The combination according to claim 1 wherein the attachment is permanently joined to the bill so as to be inseparable therefrom.

11. The combination according to claim 1 wherein the attachment is releasably joined to the bill.

12. The combination according to claim 1 wherein the bill has a top surface and a bottom surface, the attachment has a portion that resides against the top surface of the bill and there is information applied to the portion of the attachment that resides against the top surface of the bill.

13. The combination according to claim 1 wherein the attachment wraps around the edge of the bill over the entire front edge portion and no part of the attachment is capable of extending to the crown with the attachment in the operative position.

14. The combination according to claim 1 wherein the headwear piece is a baseball-style cap.

15. The combination according to claim 14 wherein the crown has an opening therein through which a wearer's head is exposed with the headwear piece in an operative position on a wearer's head.

16. The combination according to claim 14 wherein the headwear piece is a baseball cap.

17. The combination according to claim 1 wherein the crown has a front and rear, the bill projects forwardly from the crown, the attachment defines a receptacle and the attachment is placed in an operative position on the bill by directing the attachment from front to rear relative to the bill so that the bill moves into the receptacle and abuts to the attachment within the receptacle to thereby block rearward movement of the attachment relative to the bill with the attachment in the operative position.

18. The combination according to claim 17 wherein the receptacle is bounded by a wall surface and the bill abuts to the wall surface to consistently maintain the attachment in the operative position on the bill.

19. The combination according to claim 18 wherein the wall surface abuts the front edge portion of the bill with the attachment in the operative position on the bill.

20. In combination:

a) a headwear piece comprising a crown with a circumference and a bill projecting away from the crown and extending less than fully around the circumference of the crown, the bill having a front and rear, a top surface with an area, and a bottom surface, the bill further having a peripheral edge including a front edge portion that blends into spaced first and second side edge portions; and b) an attachment on the bill, the attachment engaging the bill at the front edge portion so as to consistently maintain the attachment in an operative position on the bill in a predetermined position in a direction between the front and rear of the bill and exerting a biasing force on the bill tending to impart a curved shape to the bill, the attachment constructed so that the attachment in the operative position does not cover the headwear piece in a manner that would preclude viewing thereof for display, wherein the bill is symmetrical about a center line, with the center line residing between first and second side portions of the bill, and the attachment engages the bill at first and second locations, one each on the first and second side portions of the bill, wherein the attachment wraps around the peripheral edge of the bill and has a top portion with a first front to rear dimension at the front of the bill that overlies the top bill surface and a bottom portion with a second front to rear dimension at the front of the bill that underlies the bottom bill surface, wherein the front to rear dimension of the bottom portion of the attachment is greater than the front to rear dimension of the top portion of the attachment.

21. In combination:

a) a headwear piece comprising a crown with a circumference and a bill projecting away from the crown and extending less than fully around the circumference of the crown, the bill having a front and rear, a top surface with an area, and a bottom surface, the bill further having a peripheral edge including a front edge portion that blends into spaced first and second side edge portions; and b) an attachment on the bill, the attachment engaging the bill at the front edge portion so as to consistently maintain the attachment in an operative position on the bill in a predetermined position in a direction between the front and rear of the bill and exerting a biasing force on the bill tending to impart a curved shape to the bill, the attachment constructed so that the attachment in the operative position does not cover the headwear piece in a manner that would preclude viewing thereof for display, wherein the bill is symmetrical about a center line, with the center line residing between first and second side portions of the bill, and the attachment engages the bill at first and second locations, one each on the first and second side portions of the bill, wherein the bill has a curved, inverted "U" shape to which the attachment is conformed.

* * * * *